US005150850A

United States Patent [19]

Adams

[11] Patent Number: 5,150,850

[45] Date of Patent: Sep. 29, 1992

[54] METHOD FOR WINDING A TRAVELING WEB ON A BELTED TWO DRUM WOUND WEB ROLL WINDER

[75] Inventor: Richard J. Adams, Rockton, Ill.

[73] Assignee: Beloit Corporation, Beloit, Wis.

[21] Appl. No.: 698,034

[22] Filed: May 10, 1991

[51] Int. Cl.[5] ..... B65H 18/22; B65H 20/06

[52] U.S. Cl. ..... 242/66; 242/75.1

[58] Field of Search ..... 242/66, 75.1

[56] References Cited

U.S. PATENT DOCUMENTS

| | | | |
|---|---|---|---|
| 2,165,111 | 7/1939 | Rasmusson | 242/66 |
| 2,830,775 | 4/1958 | Kiesel | 242/66 |
| 3,098,619 | 7/1963 | Washburn | 242/66 |
| 4,496,112 | 1/1985 | Olsson et al. | 242/66 |
| 4,746,076 | 5/1988 | Tomma et al. | 242/66 |
| 4,811,915 | 3/1989 | Smith | 242/66 |
| 4,842,209 | 6/1989 | Saukkonen | 242/56 |
| 4,883,233 | 11/1989 | Saukkonen et al. | 242/66 |
| 4,921,183 | 5/1990 | Saukkonen et al. | 242/66 |

FOREIGN PATENT DOCUMENTS

| | | | |
|---|---|---|---|
| 675979 | 5/1939 | Fed. Rep. of Germany | 242/66 |
| 2908294 | 9/1980 | Fed. Rep. of Germany . | |
| 417769 | 10/1934 | United Kingdom . | |

*Primary Examiner*—Daniel P. Stodola
*Assistant Examiner*—John Q. Nguyen
*Attorney, Agent, or Firm*—Dirk J. Veneman; Raymond W. Campbell; Gerald A. Mathews

[57] ABSTRACT

A method for winding a traveling web into a wound web roll supported on a two-drum belt winder having a belt looped over two fixedly mounted support drums. The tension in the belt is adjustable from an initially relieved tension condition where a depression is formed in the belt over the notch between the support drums. A new core is inserted in the depression and is wrapped by the on-coming paper web to begin forming a wound roll of paper. As the wound roll of paper increases in diameter, the tension in the looped belt is increased to provide greater support in the span between the nips of the wound roll over the belt against the support drums. Initially, a rider roll is also brought into nipping engagement with the wound paper roll. The nip load of the rider roll is gradually relieved as the diameter of the wound paper roll increases. Eventually, the rider roll is relieved except for a nominal pressure contact with the wound paper roll so that the tension of the on-coming paper web being wound into the wound roll in the nips on the support drums is essentially due to the weight of the wound roll. The wound roll is continuously supported symmetrically over a segment of its lower peripheral surface by a span of the tensioned belt and the nips of the horizontally disposed support drums.

4 Claims, 3 Drawing Sheets

METHOD FOR WINDING A TRAVELING WEB ON A BELTED TWO DRUM WOUND WEB ROLL WINDER

BACKGROUND OF THE INVENTION

1. Field of the Invention

This invention relates to winders for winding an on-coming web of material into a wound roll. More particularly, this invention relates to a two-drum winder, such as is used in the papermaking industry for winding a traveling paper web into a roll of paper. Still more particularly, this invention relates to a two-drum type of papermaking winder wherein the wound roll is supported on a looped, resilient belt over the support drums.

2. Description of the Prior Art

The two-drum type of winder, wherein the wound paper roll is supported by a pair of parallel, essentially horizontally disposed support drums, is well-known in the papermaking art. Also known is the use of support drums having either a resilient cover or a looped resilient belt disposed over the surfaces of the support drums. Finally, it is also known to support the wound paper roll by means of a separate tensioned belt on either side of the roll as it is being wound. Examples of such apparatus is shown and described in British Patent No. 417,769 and U.S. Pat. No. 3,098,619.

Improvements in two-drum types of winders which utilize a belt have recently been introduced into the market and have been patented. Such apparatus is generally characterized by utilizing a fixedly mounted, metal-surfaced support drum to support the paper roll being wound on one side of the two-drum configuration while the other side of the roll being wound is supported by a nip with either a belt-wrapped drum, or by a tensioned belt spanning spaced support drums, generally with one or both of the support drums also supporting the wound roll by nipping engagement therewith beneath the tensioned belt. Examples of such apparatus are shown and described in U.S. Pat. Nos. 4,842,209; 4,883,233 and 4,921,183.

However extensive the teaching of the use of a belt in conjunction with the support drums in a two-drum type of papermaking winder has become, there are still some shortcomings in this technology which have not been overcome by those skilled in the art. Thus, while the use of a pair of spaced, tensioned belts, each looped over a pair of spaced support drums, to support a paper web roll on either side of its center is known, as is the use of a single looped belt disposed about a pair of support drums, the use of a single looped belt in conjunction with a pair of spaced support drums for initially nipping a core with the belt and winding an on-coming paper web onto the core and into a complete wound paper roll while coordinating the belt tension has not heretofore been envisioned.

The more elaborate configurations which utilize a fixedly mounted metal support drum to support the wound roll on one side while utilizing a laterally displaceable support drum wrapped by a belt on the other side still do not permit the flexibility and range of operating characteristics and wound roll parameters, particularly at the early stages of wound roll formation, which are desired and necessary in today's competitive market where wound rolls having diameters of 60 inches (152.4 cm), or larger, are required to meet the customer's specifications.

What is characteristic of all prior belted drum winder configurations is their limited ability to maintain web tension and nip pressure, or a combination of both, which is sufficiently flexible in its range throughout the winding operation from when the newly severed web is brought into winding engagement with a new core, or reel spool, to the time when the wound roll reaches its desired maximum diameter. Specifically, the prior belted support drum arrangements did not engage the surface of the wound roll initially solely with a resilient belt, and they did not maintain engagement and support of the wound paper roll solely with the resilient belt during the entire winding process while coordinating the wound roll support with variable belt tension and the rider roll nip force.

SUMMARY OF THE INVENTION

In this invention, such coordinated web tension and nip control is accomplished by relieving the belt tension initially when the traveling web is brought into wrapping engagement with the new core, and then nipping the web against the core with the rider roll as the winding proceeds in its early stage of being wound into a complete roll. As the winding proceeds, the looped belt is tensioned over the support drums with an intermediate or neutral amount of tension to lift the core and wound roll from its relatively untensioned support by the relieved belt. In the latter stages of the winding procedure where the wound roll has acquired a substantial portion of its eventual size and weight, the looped belt is tensioned further up to its maximum amount and the rider roll is gradually relieved to eventually provide little or no nipping force against the top of the wound roll. The core/wound paper roll is thus continuously supported on both sides of its lower peripheral surface by the support drums through the nip-softening material of the belt from its initial time of being wound into a roll to its completion as a wound roll. The wound roll is also continuously supported by the tensioned belt span between the support drums. The tension in the resilient belt varies from the minimum necessary to support the new core to the maximum necessary to support the completed wound paper roll in the span between the nips of the completed wound roll on the spaced support drums. In addition, the rider roll provides variable nipping force against the core during much of the same time.

Accordingly, it is an object of this invention to provide a belt winder wherein the wound roll is continuously supported by a belt from the time the web is initially wrapped onto a new core to the completion of the wound roll.

Another object of this invention is to provide a belt winder wherein the belt tension passes through successive stages where it is initially relieved, then continuously increased as the wound roll approaches its completed diameter.

Another object of the invention is to provide a two-drum type of belt winder wherein the support drums remain fixedly mounted during the entire winding process and the belt, which is looped over both support drums, has its tension gradually increased as a function of wound roll size.

Still another object is to provide a two-drum belt winder wherein the maximum nip pressure on the wound roll is maintained below a predetermined value.

A feature and advantage of this invention is the continuous support of the wound paper roll by nipping engagement with each of the drums in a two-drum type winder with a looped, resilient belt disposed between the wound paper roll and its nipping support throughout the winding procedure from initial engagement of the paper web onto the core to the completion of the wound paper roll.

These, and other objects, features and advantages of this invention will become readily apparent to those skilled in the art upon reading the description of the preferred embodiment in conjunction with the attached drawings.

DESCRIPTION OF THE PREFERRED EMBODIMENTS

Figure 1:
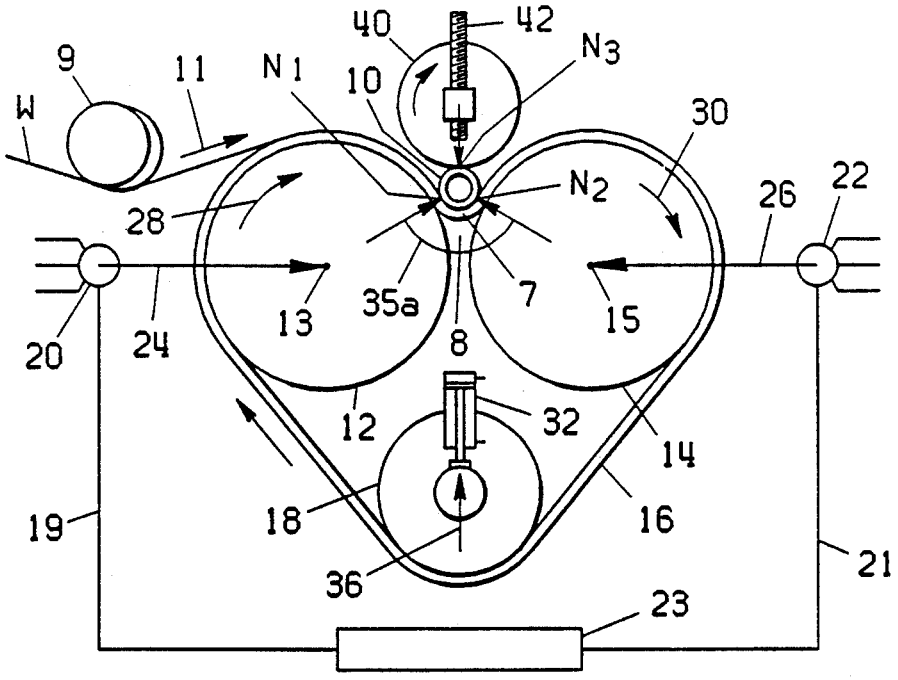
FIG. 1 is a side-elevational view, in somewhat schematic form, of a two-drum winder showing a belt looped about the drums in a relieved tension condition.

With reference to FIG. 1, a new core 10, which is sometimes referred to as a spool, is inserted into a notch, generally designated with the numeral 8, formed between the facing upper peripheral surfaces of a pair of spaced, horizontally disposed support drums 12,14 which are rotatably mounted in framework (not shown) in a winder for winding an on-coming web of paper from a papermaking machine. The structure of the winder, such as beams, bearing housings and apparatus for rotatably linking the support drums with drive motors, are well-known in the papermaking industry and, therefore, have not been shown here to facilitate the depiction and understanding of the inventive concept.

A continuous, looped belt 16 has been looped over the fixedly mounted support drums 12,14 and a belt tensioning roll 18 which is disposed within the looped belt beneath the support drums. Drive motors 20,22 are operatively connected to each of the support drums, as indicated schematically by arrows 24,26 to rotate them in the direction of arrows 28,30 to wind the on-coming paper web W onto the core to initiate the winding of a wound paper roll. The motors can also be linked electrically 19,21 via a control device 23 so that each motor can have its speed, and torque, controlled independently of the other motor. Thus, for example, motor 22 can be run faster, or provide more torque, than motor 20 to increase tension in the web being wound into a roll.

A belt tensioning device, shown schematically at 32, is operatively linked with the belt tension roll 18 to vary the belt tension from a relieved tension condition to an intermediate/neutral tension to a relatively high tension condition. These belt tensions change gradually and increase according to the diameter and weight of the paper roll being wound. The belt tensioning device 32 can be any known apparatus, such as a hydraulic piston or jack screw, which is capable of moving the belt tension roll upwardly in the direction of arrow 36 (FIG. 1) to relieve the tension in the belt to a relatively low level and then downwardly in the direction of arrow 38 (FIG. 3) to a position where the belt tension is relatively high. Intermediate these positions is an intermediate/-neutral tension which is relatively high compared with the relieved belt tension shown in FIG. 1 and relatively low compared with the relatively high belt tension shown in FIG. 3.

The belt 16 is preferably made with an inelastic base ply with an outer ply, at least on the side facing the wound paper roll, comprised of an elastic, deformable material, such as rubber (incompressible) or microporous elastomer (compressible). The belt can be of a continuous design or have a non-marking splice to facilitate the installation of a new belt having a finite length over the faces of a drum without having to cantilever the drums and mount a looped belt over the unsupported ends of the support drums. The belt is preferably comprised of a nip-softening (i.e. pressure spreading) material, but it could be a steel belt. The common concept is to distribute the wound roll support pressure between the nips on the support drums.

The belt could also be many belts, each with a separate tension roller. This allows the nip or weight compensation to be variable across the width of the machine.

Positioned above the core 10 is a rider roll 40 which is also mounted in the framework by means, not shown, to permit substantially vertical, translational movement of the rider roll relative to the core and wound roll.

Figure 4:
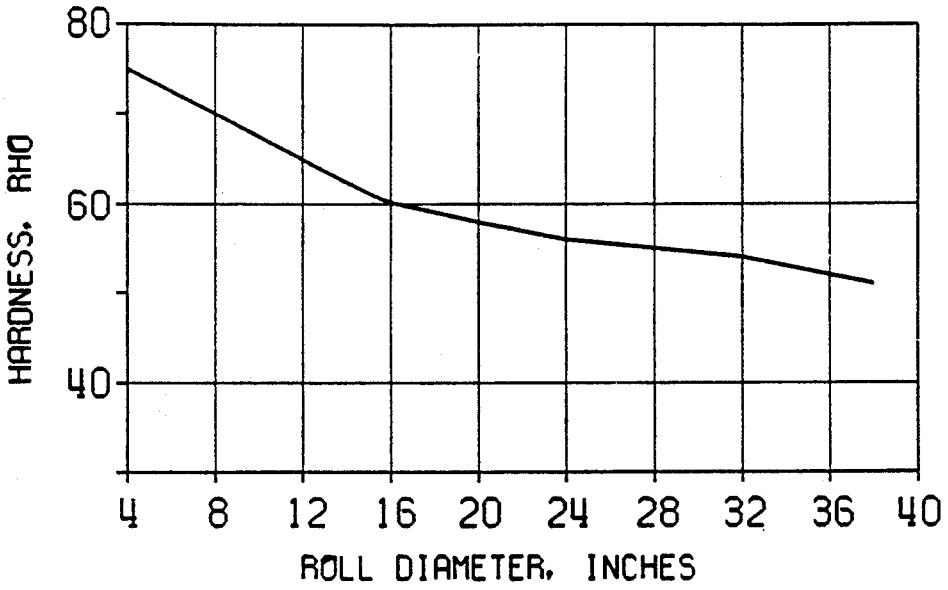
FIG. 4 is a graph which relates the desired roll hardness to the diameter of the wound roll.

FIG. 4 is a graphic representation of the hardness of a wound paper roll expressed in terms of some arbitrary value, such as Rho, which is produced by a hardness meter, such as shown and described in U.S. Pat. No. 3,425,267. It is well-known in the papermaking industry that hardness is a function of the tension of the paper web as it is being wound, and it is influenced by other factors such as sheet density, porosity and paper grade. Generally, as shown in FIG. 4, the desired wound roll hardness decreases as the roll diameter increases.

Figure 5:
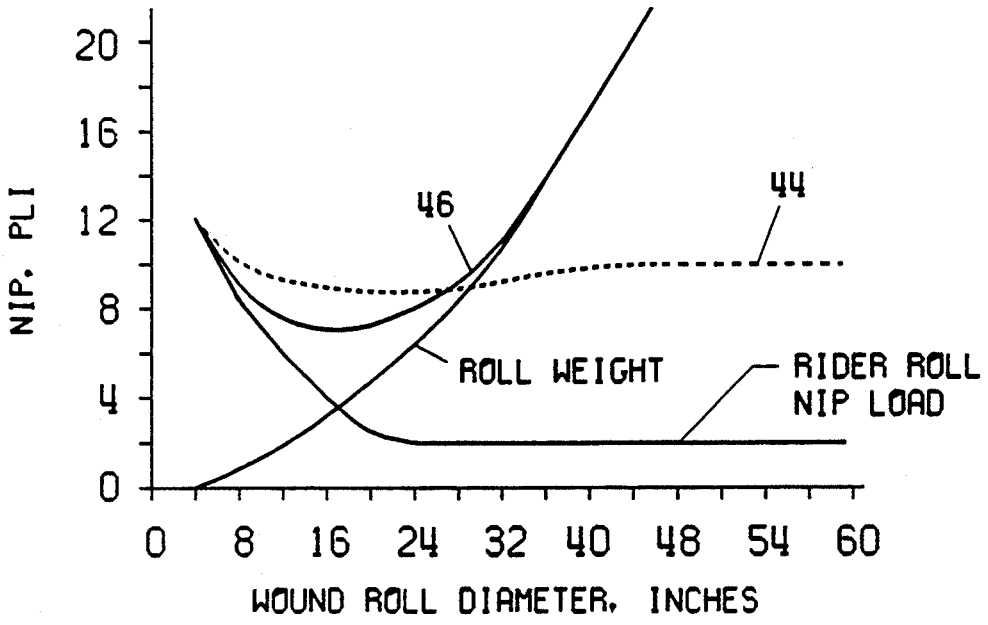
FIG. 5 is a graph of a standard two-drum winder without a belt which relates the nip of the wound roll against the support drums according to the weight of the wound roll and the rider roll loading, all as a function of the wound roll diameter. It also shows the total nip load with belt support.

FIG. 5 is a graphic illustration of the combined effect of the rider roll nip pressure on the wound paper roll combined with the weight of the paper roll as the roll diameter increases, both of which cooperate to produce the total pressure load of the wound roll against the belt (curve 44) and over the support drums without the belt (curve 46). As can be seen, the rider roll loading is at its peak when the wound roll diameter is small regardless of whether the wound roll is supported solely by the support drums without a belt, or by a belt over the support drums. In the case where the wound roll is supported solely by the support drums (i.e. in prior art types of two-drum winders which do not use a belt), the total nip on the wound roll keeps increasing with the diameter of the wound roll. The wound in tension thus also continues to increase. In some wound rolls of smaller diameters and/or with paper grades having higher tensile strengths, this does not present a problem.

However, at larger diameters over 40 inches, typically approaching 60 inches, or with paper webs having lower tensile strengths, defects in the wound roll can be caused by the increased nip/wound-in tension. These defects include crushing, bursting and wrinkling. At some point, the weight of the wound roll becomes great enough to provide the desired nip load against the support drums to maintain the desired web tension during the winding process so that no additional nip load is required of the rider roll. The nipping load of the rider roll is then relieved to a nominal amount against the wound roll to provide no significant nip load which contributes to the nip load between the wound roll and the support drums 12,14. The rider roll is maintained in contact with the wound roll to assist in keeping it in place on the support drums.

Curve 5 illustrates the basic distinction of the nip load of a wound paper roll which is supported solely on the two support drums (curve 46), and a wound roll which is supported by both nips $N_1,N_2$ on the support drums and the tensioned belt span between the support drums (curve 44). Curve 44 not only does not increase rapidly, it tends to remain at a lower, relatively constant level throughout the winding process, depending on belt tension and any speed/torque differential between the support drums, where the wound roll gradually increases in diameter to its predetermined size. The absolute nip on the wound roll is controlled to not exceed a predetermined critical level. The wound-in web tension is therefore correspondingly controlled.

Conversely, the nip between the wound roll and the support drums is initially due primarily to the rider roll loading and very little is contributed by the weight of the paper roll being wound. Accordingly, the tension of the paper web being wound into the wound roll can be controlled in conjunction with the support drum torque to produce the optimum hardness of the wound roll at each stage in its development from a relatively small diameter roll to a medium size diameter roll to a completed wound roll.

In operation, a web W traveling over a web-spreading device 9 is guided onto the outer surface of a belt 16 which is initially looped over support drums 12,14 and belt tension roll 18 somewhat loosely with little more tension than that produced by the weight of the belt itself. Belt tension device 32 is actuated upwardly in the direction of arrow 36 to provide tension relief in belt 16. This condition produces a depression 7 in the belt over the notch 8 between the support drums. A core 10 is inserted in the depression and receives the on-coming web to be wrapped over the core to begin the winding of a new wound roll WR of paper. At this point, the core and newly started paper web is supported by the belt such that the belt is nipped $N_1,N_2$ between the core/wound roll and the support drums 12,14, respectively. Thus, the core is lightly supported by the belt and primarily supported by nips $N_1,N_2$ on the support drums. Immediately, or nearly immediately, a rider roll 40 is brought into nipping engagement over the freshly started wound roll to engage the outer surface of the web being wound onto the wound roll to increase the tension of the web and the nip load against the support drums. Drive motors 20,22 are operated to provide torque to rotate the support drums 12,14 at either the same speed, or at a slight speed or torque differential, to also influence the tension of the web as it is held against the paper roll being wound.

Figure 2:
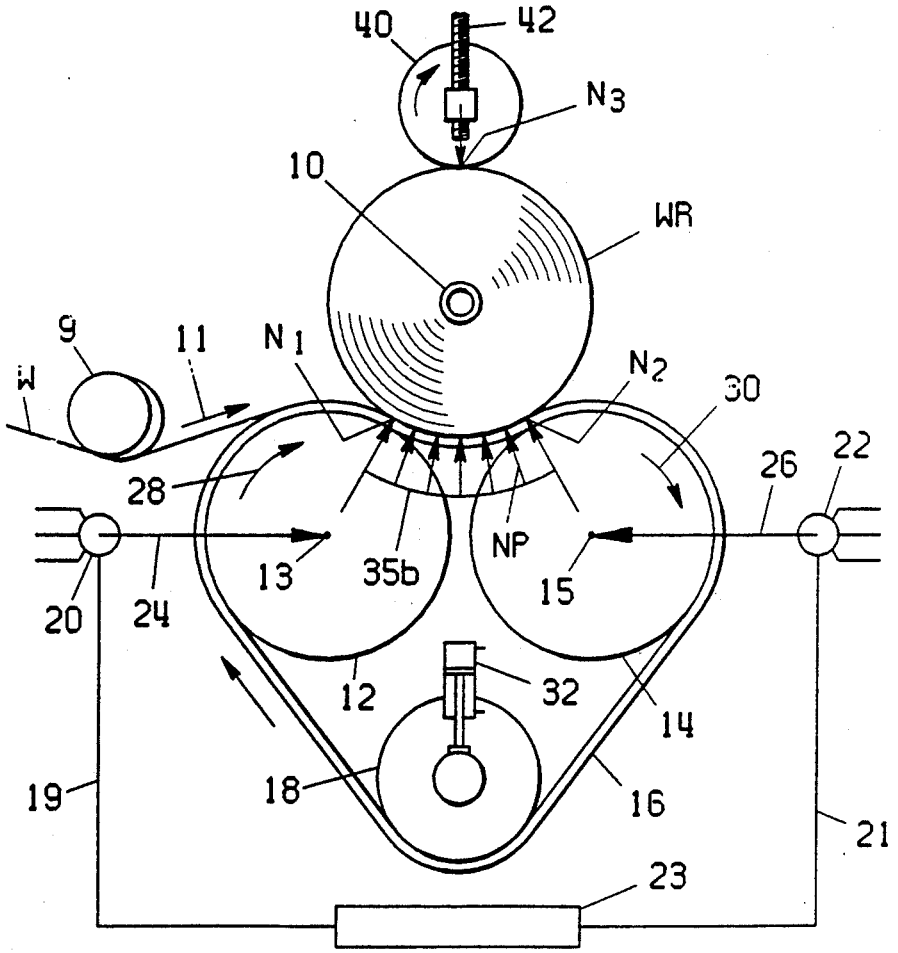
FIG. 2 is a side-elevational view, in somewhat schematic form, showing the wound paper roll in an intermediate stage of its eventual size and supported by the drums with the belt in an intermediate tension condition.

With reference to FIG. 2, as the wound paper roll increases in diameter, web tension device 32, which initially had operated to relieve the tension in the web in the direction of arrow 36 (FIG. 1), is actuated in the opposite direction to gradually move the belt tension roll 34 downwardly to gradually increase the belt tension supporting the wound roll in the span 35 between the nips $N_1,N_2$ of the wound roll on the belt over the support drums. The belt tension is increased to an intermediate amount relative to the relieved tension level shown in the belt position in FIG. 1. During this time as the wound roll diameter increases, the rider roll pressure device 42 maintains an ever decreasing nip force $N_3$ of the rider roll 40 against the surface of the wound roll WR.

Figure 3:
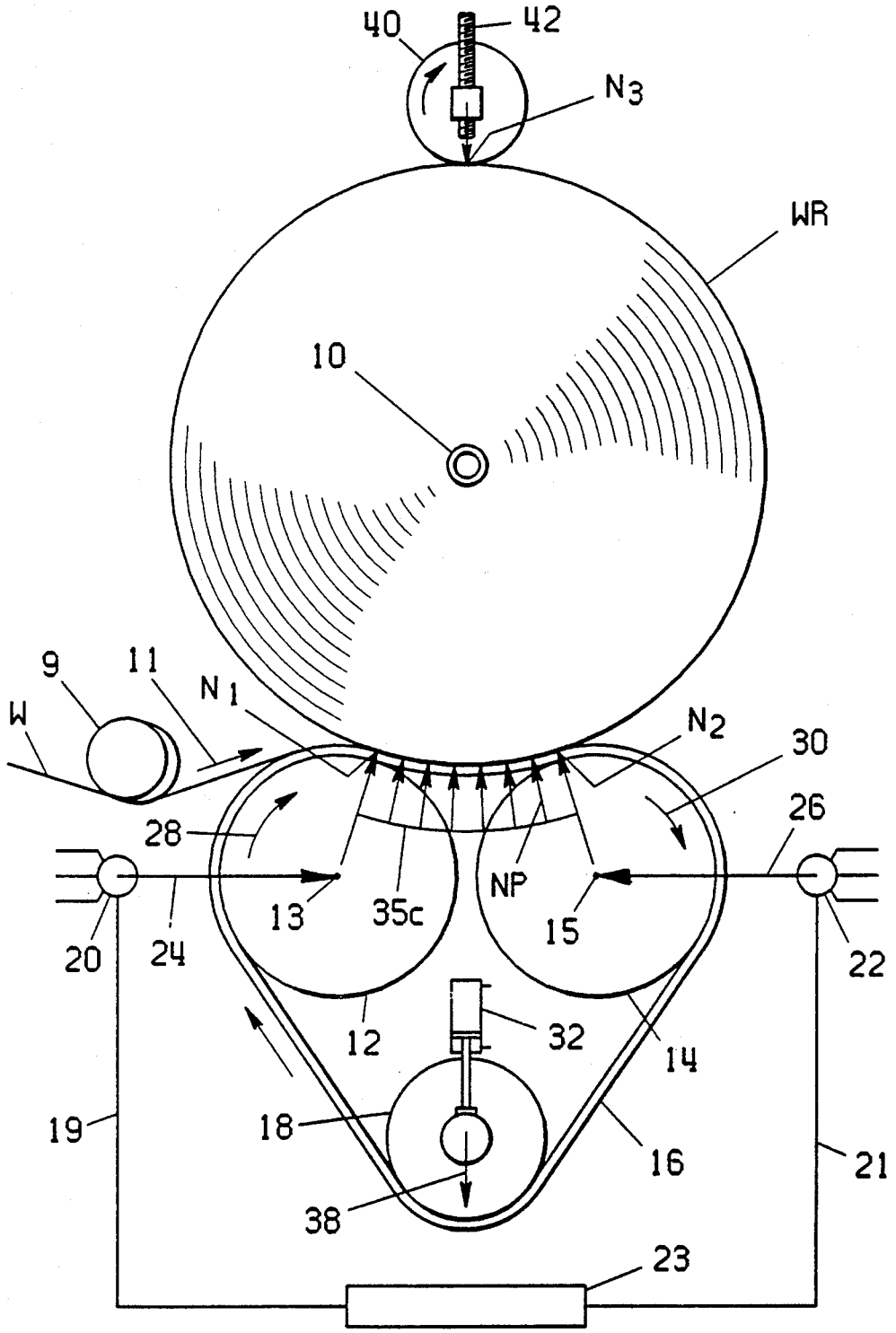
FIG. 3 is a side-elevational view, in somewhat schematic form, showing the wound paper roll near its desired finished diameter with the wound roll supported on the support drums with the looped belt at less than, or near, its maximum tension.

Finally, as the wound roll WR approaches a predetermined diameter, and, ultimately, its maximum desired diameter, as shown in FIG. 3, which might be the same, the rider roll pressure apparatus 42 relieves the rider roll nip against the surface of the wound paper roll so as to stabilize the nip load of the rider roll against the wound roll at a small amount, such as about 2 pounds per lineal inch of wound roll force width. In coordination with this action, the belt tension device 32 operates to gradually move the belt tension roll 34 downwardly in the direction of arrow 38 to gradually provide the additional belt tension in the span 35 supporting the wound roll between the nips $N_1,N_2$. The drive motors continue to drive the support drums 12,14 at the same speed, or at a speed differential, as desired, to further control the tension of the on-coming web being wound onto the wound roll. This coordinated operation of the winder support drum drive, the tension variations produced in the belt at various stages in the operation ranging from relatively relieved belt tension at or near the initial stage of the web winding process when the wound roll has a relatively small diameter, such as 20 inches or less, through an intermediate stage when the belt tension is gradually increased to a relatively intermediate, or neutral, level, such as when the wound roll is between about 20 and about 40 inches in diameter, to the stage where the wound roll is at or near its maximum size, such as about 40 inches to about 60 inches in diameter, where the belt tension device has gradually urged the belt tension roll downwardly to provide additional belt tension and, eventually, the maximum belt tension. This coordinated operation of the various components produces a desirable nip load profile NP in the saddle span between the nips $N_1,N_2$ of the wound roll over the support drums throughout the range of operation from when the web is initially brought onto a new core to when the wound roll is finished. The area of the nip load profile also gradually increases from a relatively small amount in a smaller span **35*a*, as shown in FIG. 1, to a relatively larger amount in the relatively larger span 35*b* shown in FIG. 2 to a relatively still larger amount 35*c* shown in FIG. 3. This is possible despite the fixedly mounted support drums 12,14** due to the coordinated corresponding belt tension which ranges between a relatively relieved level through an intermediate level to a relatively full tension level.

It should be noted that the increase in the span size from **35*a* to 35*c* is accompanied by a corresponding change in the orientation and location of the radially extending nip vectors $N_1,N_2$ from the axes of rotation 13,15 of drums 12,14**, respectively.

Examples of the size and range of operating parameters can be given as follows:

The support drums 12,14 can be 24 inches in diameter with the eventual size of the wound roll 60 inches in diameter. The span of the tensioned belt saddle extending between nips $N_1,N_2$ of the wound roll over the support drums can be about 13 inches supporting 52 pounds per lineal inch with a distributed load of the finished wound roll of about 4 pounds per lineal inch per inch of saddle span width.

Initially, the rider roll might nip the newly deposited core with the new web (FIG. 1) with a nip load of about 12 pounds per lineal inch (PLI). When the roll has reached an intermediate diameter (i.e. about 30 inches), the rider roll nip has been gradually relieved to about 2 PLI. It remains at about this nominal amount until the wound roll reaches its desired finished size. Also during the gradual growth of the wound roll, the belt is being tensioned to provide more of the total support. Thus, initially, the core is nipped against the support drums with a nip of about 12 PLI and this decreases only slightly, to abut 11 PLI, as the belt is tensioned and gradually assumes more of the wound roll support in the span between nips $N_1,N_2$.

Naturally, variations in the invention can be effected by those skilled in the art without departing from the spirit and scope of the appended claims which alone define the scope of the invention.

What is claimed is:

1. A method for winding a traveling web into a wound web roll supported on a two-drum type of winder wherein two winder drums are disposed on either side of the wound web roll, comprising the steps:

1) mounting a looped belt about the two winder drums to provide a wound web roll receiving and supporting span between the winder drums;
2) controlling the belt tension in the span by utilizing a control means for selectively producing graduated transitions between conditions of full tension, intermediate tension and tension relief of the looped belt about the winder drums;
3) actuating the control means to relieve the belt tension to provide a core-receiving depression in the belt in a notch between the winder drums;
4) depositing a core in the core-receiving depression and maintaining the core in nipping engagement with both winder drums through the belt;
5) bringing the end of the traveling web into wrapping engagement with the core to initiate the winding of the web into a wound web roll;
6) driving the winder drums to continue the process of winding the web into a wound web roll;
7) bringing a rider roll into nipping engagement with the wound web roll substantially simultaneously with the beginning of the driving of the winder drums.

2. The method for winding a traveling web into a wound web roll as set forth in claim 1, including the additional step of:

actuating the control means to gradually produce a condition of relative intermediate tension in the belt in the span of the belt between the places of nipping engagement of the wound web roll on the drums.

3. The method for winding a traveling web into a wound web roll as set forth in claim 1, wherein:

the belt includes at least an outer surface which is elastic so as to resiliently support the wound web roll in nipping engagement with the winder drums.

4. The method for winding a traveling web into a wound web roll as set forth in claim 1, further including the step:

actuating the control means for gradually producing a condition of relative full tension in the belt when the wound web roll has reached a predetermined diameter.

* * * * *